United States Patent [19]

Volkers et al.

[11] 4,140,870

[45] Feb. 20, 1979

[54] CABLE GROUNDING SYSTEM

[75] Inventors: Jack C. Volkers, Elgin; Edward W. Turska, Crystal Lake; Joseph J. Bart, St. Charles, all of Ill.

[73] Assignee: Illinois Tool Works Inc., Chicago, Ill.

[21] Appl. No.: 871,264

[22] Filed: Jan. 23, 1978

[51] Int. Cl.[2] ..... H01R 3/06

[52] U.S. Cl. ..... 174/78; 85/50 R; 151/37; 339/14 L

[58] Field of Search ..... 174/78; 339/14 R, 14 L, 339/95 R, 97 R, 263 R, 263 L; 151/37, 35, 41, 40; 85/50 R

[56] References Cited

U.S. PATENT DOCUMENTS

| | | | |
|---|---|---|---|
| 2,619,145 | 11/1952 | Poupitch | 151/37 |
| 2,681,678 | 6/1954 | Hage | 151/37 |
| 2,859,423 | 11/1958 | Hyman | 339/14 L |
| 3,678,979 | 7/1972 | Biorklumd | 151/37 |
| 3,757,269 | 9/1973 | Baumgarther et al. | 174/78 X |
| 3,785,420 | 1/1974 | Bradley et al. | 151/37 |
| 4,031,936 | 6/1977 | Curtis | 151/37 |

*Primary Examiner*—Thomas J. Kozma

*Attorney, Agent, or Firm*—Thomas N. Buckman; Robert W. Beart

[57] ABSTRACT

An improved fastener assembly system for grounding multiconductor, shielded cables. The assembly includes a saddle-shaped stud device and a preassembled nut and clamping washer. The clamping washer including a conical spring section and downwardly extending penetrating teeth to pierce the outer insulative sheath of the cable bringing the teeth into conductive contact with the metallic shield. The penetration of the teeth through the outer layer of elastomeric material eliminates the cold flow relaxation problems which could contribute to an ineffective grounding system.

8 Claims, 8 Drawing Figures

CABLE GROUNDING SYSTEM

BACKGROUND AND SUMMARY OF THE INVENTION

This invention relates broadly to grounding terminals and more particularly to terminal assemblies adapted for creating a grounding path from a grounding shield layer in a multiconductor communication cable.

Multiconductor cables are widely used to convey communication and various low strength signals and must be carefully shielded, usually by a metallic shield layer as part of a multilayer cable construction. The outer layer of such a cable is usually of an elastomeric wear-resistant material of a given thickness. The shield is usually directly beneath the elastomeric coating and is typically of a relatively thin, highly conductive material, such as aluminum. Frequently, the innermost surface of the shield is coated with a very thin layer of nonconductive material to avoid any potential contact with the conductors contained therein. It is the existence of the insulative layers both on the outer and inner surfaces of the shield that has created problems in effecting an efficient grounding path from the shield to an external grounding connection.

For example, one prior art proposal utilizes a stud with a shoe inserted in the cable so that the upper surface of the shoe is in contact with the inner surface of the shield. The stud extends outwardly of the cable either through an aperture formed in the outer insulative layer and shield or through a slit created longitudinally in the outer layers. A clamping plate and nut are inserted over the stud and clamping pressure applied to the system draws the shoe tightly up into engagement with the inner surface of the shield. The conductive path is then formed from the shoe through the stud to a secondary grounding strap which is connected and clamped to the stud. This system, however, also places the outer elastomeric material in compression and, with time, this elastomeric material will be subjected to cold flow causing the joint to relax and consequently causing the aggressive clamping pressure between the shoe and the sheath to diminish. Such a situation, obviously, creates an unreliable bounding path.

Improvements to such systems have been developed wherein a plurality of conductive paths are created in a system as generally described by placing a U-shaped, highly conductive strap between the shoe and the sheath at one end and between the upper pressure plate and a clamping nut at the other end. This, while producing a higher capacity connection, still does not overcome the cold flow problem presented by allowing the elastomeric sheath to become an active part in the clamping system.

Accordingly, it is a primary object of this invention to provide a grounding clamp assembly for use in shielded, multiconductor cables which produces a resilient clamping joint that does not include the elastomeric outer sheath as part of the active clamping system.

A further object of the invention is to provide an easily installed and handled clamping system which effects a grounding path from the conductive shield of a multiconductor cable to an outside grounding source.

An accompanying advantage of the invention is the creation of a grounding connector which will accommodate various relaxations in the clamping joint without harming the efficiency of the electrical connection.

A still further advantage of the present invention is the incorporation of a high-strength, mechanical clamping connector which provides a plurality of conductive paths from a shield in a multiconductor cable to a grounding strap.

The above and other objects and advantages are obtained by the three principal parts of the invention comprising a stud member having a radially extending flange, a preassembled nut and washer with insulation-piercing and spring take-up features and a prevailing torque or self-locking clamping nut adapted to clampingly secure a grounding strap to stud and preassembled nut and washer. The washer is preassembled to the nut in a conventional fashion but the washer itself is configured to provide a conical spring section at its inner periphery and a plurality of downwardly extending teeth members at its outer periphery. The teeth members preferably extend generally parallel to the axis of the washer and are adapted to pierce completely through the outer elastomeric sheath of a cable and into aggressive clamping connection with the upper surface of the shield. The teeth are also advantageously configured to that their free extremities include some means to limit the extent of penetration into the shield so as to not completely penetrate but only to embed into the upper surface. The flange of the stud is, preferably, arcuate in profile and has serrations formed on its upper surface to enhance the conductive contact between the lower or inner surface of the shield and the stud.

The invention may also include some configuration on the stud device, such as a polygonal head-like protrusion, within the arcuate, concave surface of the flange to prevent relative rotation between the stud and the cable during assembly. A modification of the preferred embodiment of the invention may be an asymmetrical arrangement of teeth about the periphery of the washer. This will aid in shipping and handling in that a mass of nut and washer assemblies will resist nesting or tangling with one another.

BRIEF DESCRIPTION OF THE DRAWINGS

Other objects and advantages of the invention will become apparent upon reading the following detailed description and upon reference to the drawings in which -

DETAILED DESCRIPTION OF THE INVENTION

Figure 1:
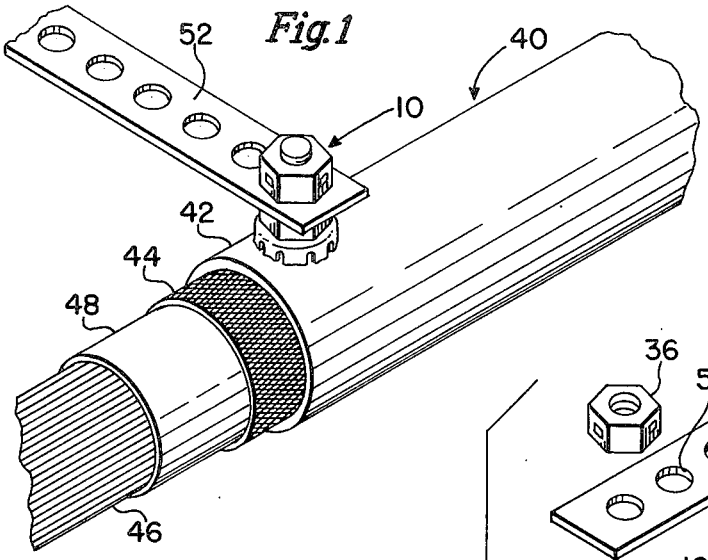
FIG. 1 is a perspective view of the grounding system of the invention as assembled on a shielded cable.

Referring to the drawings in detail, the three part assembly of the invention is generally denoted by the numeral 10. The three parts comprise a stud-like device having a saddle-shaped flange, a preassembled nut and specifically configured piercing and spring washer, and a locking nut designed to clamp an external grounding strap to the stud.

Figure 2:
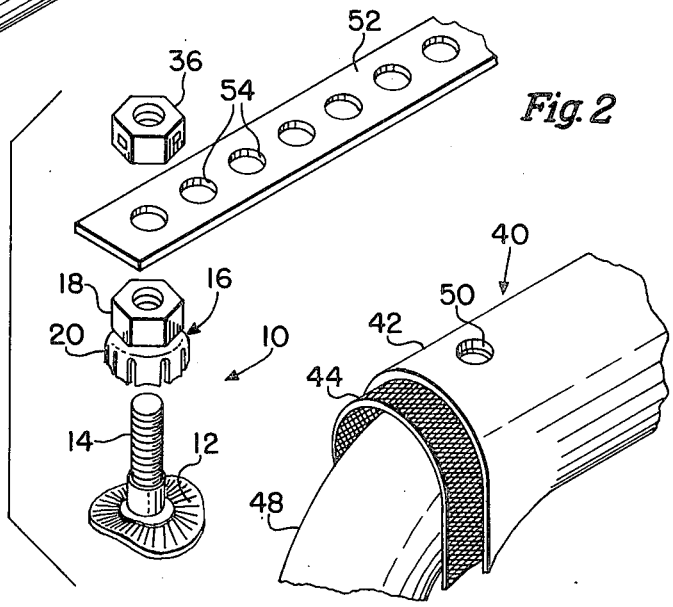
FIG. 2 is an exploded perspective view of the grounding system of the invention in readiness for assembly to a shielded cable.

In use, as shown in FIGS. 1 and 2, the assembly 10 is effectively utilized to create a reliable electric grounding path from a shield portion of a multilayer, multiconductor cable 40. A typical cable of this type will include a plurality of conductors 46 designed to convey communication or other low strength signals. These plurality of conductors may be sheathed or contained by a mylar layer 48. In order to eliminate "noise" in the conductors, a thin layer 44 of shielding material is included in the multilayer cable. This shield is typically of a highly conductive, thin material, such as aluminum. To provide strength, durability, and ease of handling, a somewhat thicker outer sheath 42 of elastomeric material, such as polyethylene, is included in the cable system.

Figure 3:
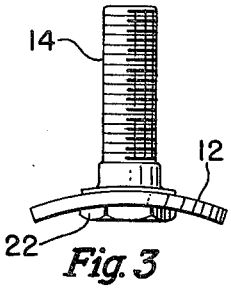
FIG. 3 is a side elevational view of the stud device embodied in the invention.
Figure 4:
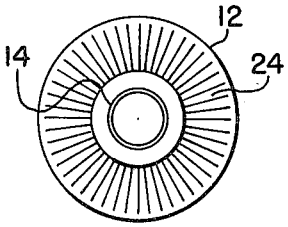
FIG. 4 is a top plan view of the stud device of FIG. 3.
Figure 6:
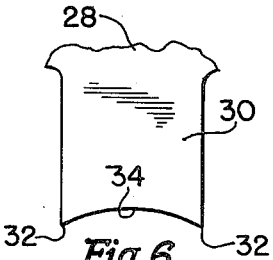
FIG. 6 is an enlarged elevational view of one tooth of the washer which is shown in FIG. 5.

The stud device of the invention is basically a radially enlarged flange or saddle portion 12 with an upstanding, somewhat centrally disposed threaded shank 14 secured to the flange. As shown in FIGS. 2 and 3, the side profile of the flange is arcuate or saddle-shaped to conform to the curvature of the various cable surface. For purposes to be described later herein, the uppermost surface of the flange 12 may advantageously be provided with radially extending serrations 24 and the lowermost surface may be provided with a low profile, polygonally shaped protuberance 22.

The nut and washer assembly 16 includes a somewhat conventional nut 18 with a washer 20 secured, but free to rotate relative to the nut, by an upwardly swaged, tubular extension 26 on the nut. Attention is directed to the innermost periphery 28 of the washer and to the outermost periphery, comprising a plurality of downwardly extending teeth 30. Region 28 of the washer is conically shaped, presenting a spring section that can be resiliently compressed as downward clamping force is applied to the assembly 16. Teeth 30 are preferably of a length or longitudinal extent sufficient to penetrate completely through the thickness of the outer polymeric sheath 42 and into aggressive, conductive contact with the shield 44. Attention is particularly directed to the extremities of the teeth 30 which are shown to include a pair of sharp points 32 interconnected by a shallow, arcuate edge surface 34. Thus, a means is created, by the arcuate edge surface 34, for limiting the penetration of points 32 into the conductive shield 44. The depth of penetration is so limited to allow embedment in the shield but not complete penetration therethrough.

In order to enhance the effectiveness of the assembly 10, the stud is preferably constructed of a conductive material, such as bronze, while the washer is configured of a highly conductive, hardenable material, such as beryllium copper, in order to obtain the spring desired in the joint.

Figure 8:
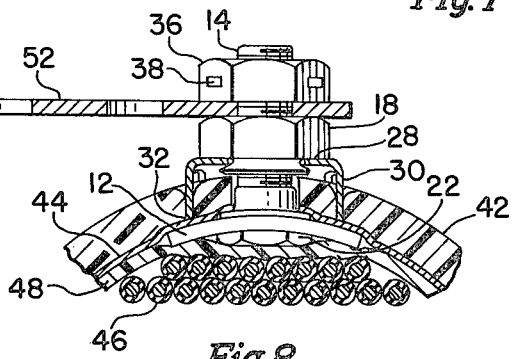
FIG. 8 is an enlarged, partial cross-sectional view as taken transverse the cable and grounding system of the invention.

The various structural details of the assembly 10 and the accompanying advantageous functions thereof, will be clear upon a detailed analysis of the assembly in operation while viewing FIGS. 2 and 8 in addition to the figures showing the structural features in detail. The stud device is first positioned so that the saddle-like flange 12 is interposed between the inner or lowermost surface of the shield 44 and the mylar covering 48. This may be accomplished by a longitudinal slit in the polymeric sheath and shield on one side of the cable and the formation of a hole 50 on the opposite side, with the conductors being bent downwardly away from the aperture permitting the insertion of the shank 14 upwardly therethrough. Alternatively, the stud may simply be inserted beneath the shield 44 along the longitudinal slit.

Once the stud is in position with the arcuate saddle-like flange 12 conforming to the curvature of the cable surfaces, the preassembled nut and washer assembly 16 is applied to the threaded shank 14. In doing so, it may be advantageous to retain the shank from rotation through a wrenching of the low profile, polygonally configured protuberance 22. The assembly 16 is rotated on the shank until the penetrating teeth 30 touch the outer sheath material 42. Since the washer is free to rotate relative to the nut, further tightening creates a pure downward motion on the washer while the nut is rotated. The teeth freely penetrate through the entire thickness of the sheath 42 until they are in contact with the conductive shield 44. Further tightening of the nut permits substantially all of the penetrating points 32 to contact and embed in the upper surface of the shield 44.

The contact of all the teeth on the washer with the arcuate configuration of the shield 44 is permitted by the conical spring, inner section 28 on the washer. In addition, the spring in the washer provides prevailing, resilient clamping pressure in the metal to metal electrical connection thus created and, therefore, allows the washer to take up or accommodate any relaxation in the connection pressure.

It should be noted that the elastomeric sheath 42 is not an active part of the compressive joint. Thus, any cold flow or relaxation of the polymeric which may result if it is placed under compression, does not at all effect the clamping pressure of the joint.

A further advantage, as mentioned above, of the invention is shown in the configuration of the penetrating points of the teeth. A shallow, concave surface 34 interconnecting a pair of points 32 allows a plurality of points on each tooth to embed but not completely penetrate the shield. Such complete penetration could result in a diminishment of the aggressive, electrical contact desired and relax the joint substantially.

Since it is somewhat common practice to coat the innermost surface of the shield with an insulating film, the combination of clamping pressure and biting contact of serrations 24 with the undersurface of the shield creates a first conductive path from the shield to the external grounding means. A second conductive path will have also been created between the plurality of radially spaced penetrating points 32 and the upper surface of the shield 44.

Once the appropriate clamping pressure has been achieved, a grounding strap 52 with apertures 54 may readily be associated with the assembly and clamped against the nut 18 by a locking or prevailing torque nut 36. One example of such a nut is that which includes an indentation such as 38 to deform the threads of the nut. The upper clamping surface of nut 18 may be provided with nibs, serrations or the like (not shown) to enhance the biting electrical contact between the grounding strap and the nut members.

Figure 7:
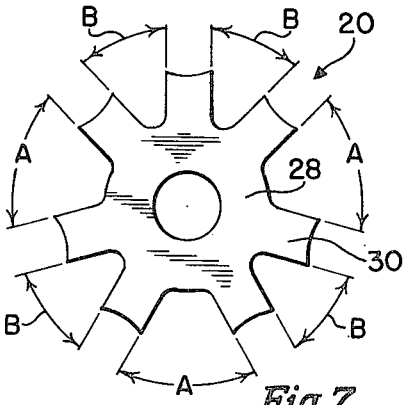
FIG. 7 is a top plan view of a blank used to form an embodiment of the washer of the invention.
Figure 5:
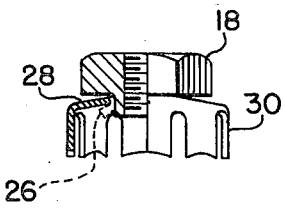
FIG. 5 is a side elevational view, partly in section, of a nut and washer assembly of the invention.

Since one of the advantages of the invention is the ease of installation and handling as a result of the minimization of parts, an alternate embodiment of the washer configuration may include an asymmetric or unequally spaced arrangement of teeth 30 about the periphery of the conical section 28. For example, FIG. 7 shows three groups of teeth, some being spaced an angular distance A away from one another while others are spaced a smaller angular distance B from one another. This asymmetric arrangement prevents the nesting or tangling of the teeth of the assembly when they are packaged together.

Thus, it is apparent that there has been provided in accordance with the invention a clamping assembly for effectively creating a grounding of a shielded, milticonductor cable that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

We claim:

1. In a grounding system for an electrically shielded cable, a stud device, including a threaded shank having a radially extending flange at one extremity adapted to be positioned beneath the shield within the cable, a low profile, polygonally-shaped protuberance formed at the undersurface of the flange, a preassembled nut and washer device adapted to be threadingly associated with the threaded shank to clampingly engage the upper surface of the shield, the washer member configured to include an inner, peripheral conical spring section with a plurality of circumferentially spaced teeth members extending downwardly therefrom, wherein the system is operable to clampingly, resiliently engage both sides of a shield to effect a plurality of reliable conductive paths from the shield to an external grounding means connected to the system.

2. The grounding system of claim 1, wherein the stud device includes means to prevent relative rotation between the stud device and the cable during assembly.

3. The grounding system of claim 1, wherein the flange is saddle shaped to conform to the curvature of the cable surfaces.

4. The grounding system of claim 1, wherein the flange includes radially extending serrations formed in the upper surface.

5. The grounding system of claim 1, further including a clamping nut adapted to be juxtaposed over the nut and washer device securing a grounding means therebetween.

6. In a grounding system for an electrically shielded cable, a stud device, including a threaded shank having a radially extending flange at one extremity adapted to be positioned beneath the shield within the cable, nut and washer members cooperably adapted to be threadingly associated with the threaded shank to clampingly engage the upper surface of the shield, the washer member configured to include an inner, peripheral conical spring section with a plurality of circumferentially spaced teeth members extending downwardly therefrom, the lowermost extremity of each tooth member including piercing point means and the lowermost edge of each tooth being concave presenting a pair of spaced piercing points interconnected by a shallow arcuate edge surface which serves to limit the penetration depth of each piercing point, wherein the system is operable to clampingly, resiliently engage both sides of a shield to effect a plurality of reliable conductive paths from the shield to an external grounding means connected to the system.

7. In a grounding system for an electrically shielded cable, a stud device, including a threaded shank having a radially extending flange at one extremity adapted to be positioned beneath the shield within the cable, nut and washer members cooperably adapted to be threadingly associated with the threaded shank to clampingly engage the upper surface of the shield, the washer member configured to include an inner, peripheral conical spring action with a plurality of circumferentially spaced teeth members extending downwardly therefrom, the plurality of teeth members being unequally spaced about the outer perimeter of the conical spring section, wherein the system is operable to clampingly, resiliently engage both sides of a shield to effect a plurality of reliable conductive paths from the shield to an external grounding means connected to the system.

8. A grounding system including in combination a multilayer, multiconductor cable having an outer insulative elastomeric sheath of predetermined thickness, a stud device, including a threaded shank having a radially extending flange at one extremity adapted to be positioned beneath the shield within the cable, a preassembled nut and washer device adapted to be threadingly associated with the threaded shank to clampingly engage the upper surface of the shield, the washer member configured to include an inner, peripheral conical spring section with a plurality of circumferentially spaced teeth members extending downwardly therefrom, the cable including a conductive shield layer beneath said elastomeric sheath, a plurality of discrete conductors surrounded by said shield and elastomeric sheath, the flanged positioned beneath the shield, means in said shield and sheath permitting the stud shank to protrude therethrough, the compressed height of the washer being not substantially less than the thickness of the elastomeric sheath so that the teeth may pierce through said sheath into contact with the upper surface of the shield thereby clamping the shield between the washer and flange creating a reliable conductive path from both sides of the shield wherein the system is operable to clampingly, resiliently engage both sides of a shield to effect a plurality of reliable conductive paths from the shield to an external grounding means connected to the system.

* * * * *